United States Patent [19]

Casey

[11] 4,019,588

[45] Apr. 26, 1977

[54] TILTING MEANS FOR BULLDOZER BLADES

[75] Inventor: Thomas P. Casey, Burlington, Iowa

[73] Assignee: Caterpillar Tractor Co., Peoria, Ill.

[22] Filed: June 30, 1975

[21] Appl. No.: 591,662

[52] U.S. Cl. ..... 172/804; 172/484; 172/666; 172/743; 172/807

[51] Int. Cl.[2] ..... E02F 3/76; A018 65/00

[58] Field of Search ..... 172/305, 307, 324, 444, 172/446, 476, 477, 482, 484, 491, 463, 666, 667, 739, 740, 741, 742, 743, 744, 793, 797, 801, 802, 803, 804, 805, 806, 807, 808, 809; 37/118 R, 118 A, 193; 214/146.5, 701 Q, 768, 773, 775, 776, DIG. 10

[56] References Cited

UNITED STATES PATENTS

| | | | |
|---|---|---|---|
| 2,534,886 | 12/1950 | Stueland | 214/773 |
| 3,007,590 | 11/1961 | Mathew et al. | 214/773 |
| 3,016,635 | 1/1962 | Aston | 172/808 |
| 3,195,248 | 7/1965 | Martin | 214/775 X |
| 3,337,974 | 8/1967 | Fisher | 172/807 |
| 3,369,686 | 2/1968 | Vondra | 214/768 |
| 3,570,152 | 3/1971 | Schuermann et al. | 172/739 X |
| 3,590,929 | 7/1971 | Wirt | 172/803 |
| 3,653,451 | 4/1972 | Fryrear et al. | 172/804 |
| 3,762,590 | 10/1973 | Grooss | 214/775 |
| 3,913,684 | 10/1975 | Casey et al. | 172/804 |

*Primary Examiner*—Richard T. Stouffer
*Attorney, Agent, or Firm*—Phillips, Moore, Weissenberger, Lempio & Majestic

[57] ABSTRACT

A bulldozer assembly comprises a pair of laterally spaced push arms pivotally interconnected between a blade thereof and a vehicle. A pair of lift cylinders are also pivotally connected between the vehicle and the blade for selectively raising or lowering the blade relative to the vehicle. A tilt mechanism for selectively tilting the normally upright blade in a vertical plane comprises first and second members each pivotally interconnected between the vehicle and the blade on an outboard side thereof. A double-acting cylinder is pivotally interconnected between inboard sides of the members for selectively pivoting the members relative to each other to tilt the blade.

12 Claims, 3 Drawing Figures

TILTING MEANS FOR BULLDOZER BLADES

BACKGROUND OF THE INVENTION

This invention relates to an improved tilting means particularly adapted for selectively tilting a bulldozer blade. Conventional bulldozer assemblies normally comprise means for selectively tilting the blade thereof relative to ground level during grading operations and the like. U.S. Pat No. 3,395,764, for example, discloses a conventional tilting arrangement comprising a brace in the form of a hydraulic cylinder pivotally interconnected between a push arm of the bulldozer assembly and a blade thereof for tilting purposes. Thus, the push arms function as the sole means for absorbing compressive forces imposed on the blade and transmitting the same to the frame of the vehicle.

SUMMARY OF THIS INVENTION

An object of this invention is to provide a combined support and tilt means in the mounting arrangement interconnecting a work implement with the frame of a vehicle. The tilt means comprises a pair of first and second members each pivotally interconnected between the work implement and the vehicle and extensible and retractable actuating means pivotally interconnected between the members for selectively pivoting them relative to each other to tilt the work implement. The noncomplex and economical tilt means, essentially constituting three component parts, will further function to transmit forces imposed on the work implement during operation thereof directly to the vehicle to thus share such loads with a pair of push arms preferably also interconnected between the work implement and the vehicle.

BRIEF DESCRIPTION OF THE DRAWINGS

Other objects of this invention will become apparent from the following description and accompanying drawings wherein.

DETAILED DESCRIPTION

Figure 1:
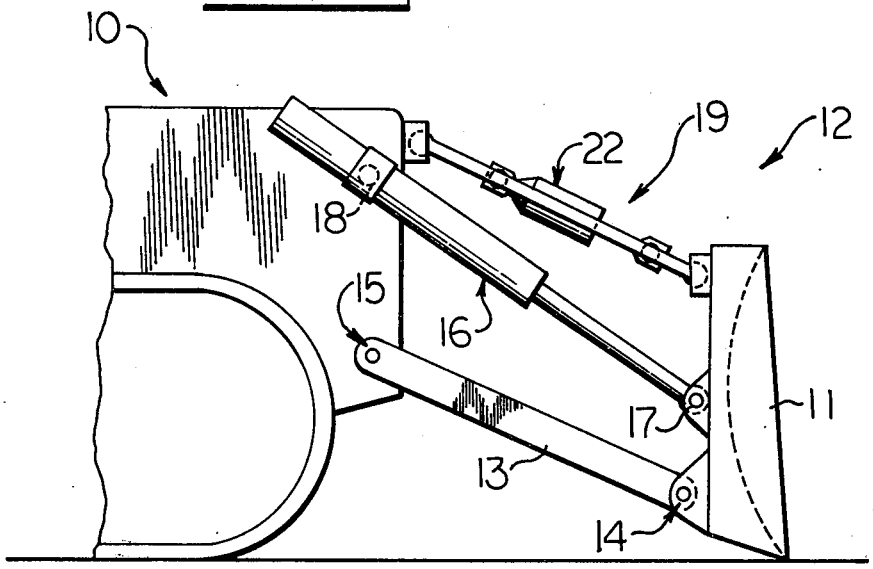
FIG. 1 is a side elevational view of a mounting arrangement, employing combined support and tilt means of this invention therein, operatively interconnected between a bulldozer blade and the frame of a vehicle.

FIG. 1 partially illustrates a track-type tractor 10 having a normally upright blade 11 of a bulldozer assembly 12 disposed forwardly thereof. The mounting arrangement interconnecting the blade with a frame of the vehicle comprises a pair of laterally spaced push arms 13 each interconnected between the blade and the vehicle by universal pivot means 14 and 15, respectively. The mounting arrangement further comprises a pair of double-acting lift cylinders 16 each having its rod end pivotally connected to the blade by a pin 17 and to the vehicle by a trunnion 18 for selectively raising or lowering the blade relative to ground level.

The mounting arrangement further comprises a combined support and tilt means 19 including a pair of co-planar first and second members 20 and 21 and an extensible and retractable actuating means 22. The actuating means preferably constituting a double-acting hydraulic cylinder disposed in an imaginary vertically disposed plane intersecting a longitudinal axis of the vehicle. Each of the members may be shaped as a scalene triangle having an outboard side or base 23 thereof operatively interconnected between the blade and the vehicle by universal pivot means 24 and 25, respectively. The adjacent and longitudinally spaced inboard sides or apexes 26 of the members are pivotally connected to opposite ends of cylinder 22 by universal pivot means 27 and 28. All of the above-referenced universal pivot means are preferably of the illustrated ball and socket type connections.

The lateral stability of the blade is assured by a pair of triangular strut arrangements 29 and 30 secured to the respective push arms 13. The inboard ends of the strut arrangements may be operatively connected together by a ball and socket joint 31. Such bracing arrangement is substantially of the type disclosed in U.S. Pat. No. 3,395,764, assigned to the assignee of this application.

In operation, forward movement of tractor 10 during a bulldozing operation will function to impose compressive loads on blade 11. Such loads will be transmitted through push arms 13 and tilt means 19 for absorption by the frame of the tractor. As shown in FIG. 1, the push arms and tilt means form parallel sides of a parallelogram-type linkage extending downwardly from the vehicle towards blade 11 for permitting lift cylinders 16 to selectively raise and lower the blade.

Figure 2:
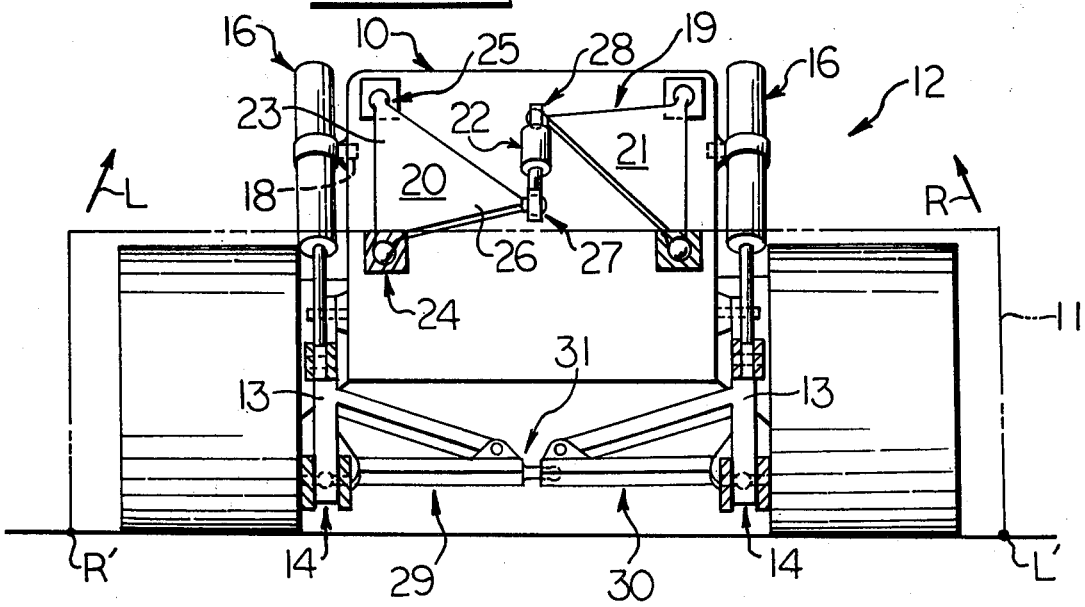
FIG. 2 is a front elevational view of the FIG. 1 constructions, but with the bulldozer blade shown in phantom lines for clarity purposes.
Figure 3:
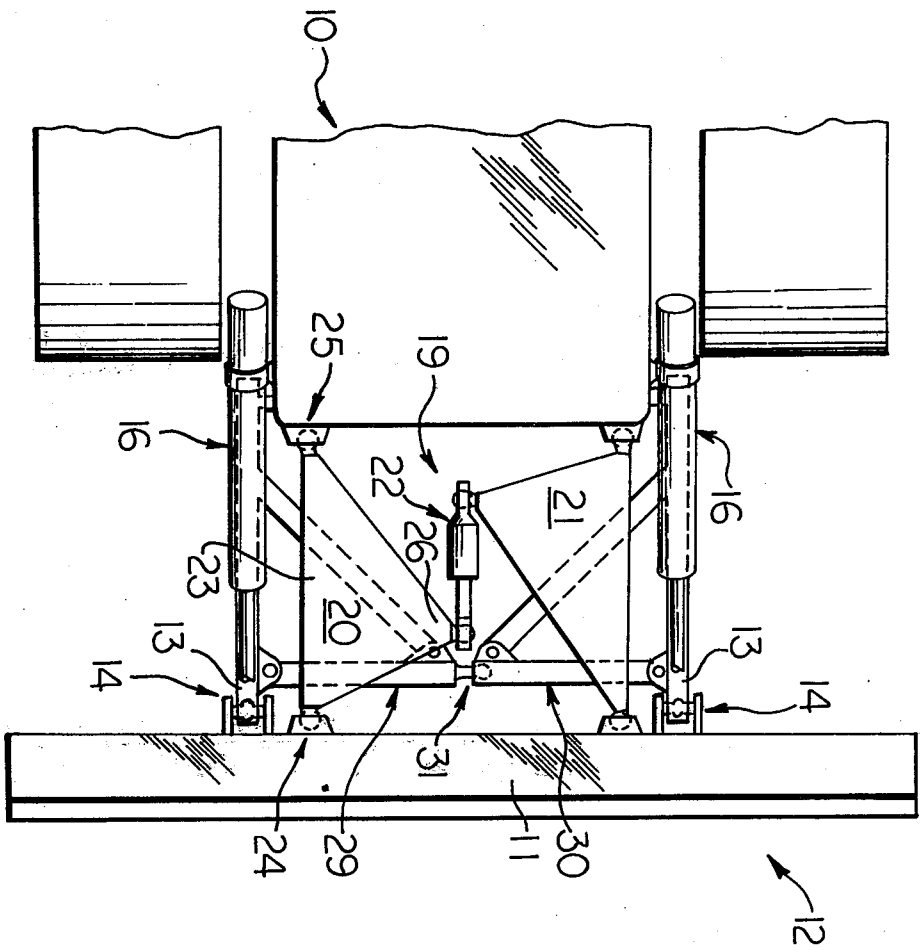
FIG. 3 is a top plan view of the FIG. 1 constructions.

Referring to FIG. 2, when it is desired to lift the left side of blade 11, for example, cylinder 22 is suitably retracted by hydraulic control means (not shown) to pivot members 20 and 21 about pivot means 25 to thus pivot such members and blade 11 in the direction of arc L. During such tilting phase of blade operation, the lower righthand end of the blade will react against the ground at point L′ to permit members 20 and 21 to function as a lever to perform the tilting function.

When it is desired to tilt the blade by raising the righthand side of the blade in FIG. 2, cylinder 22 is extended. Such extension will cause members 20 and 21 to pivot and raise blade 11 in the direction of arc R upon reaction of the left lower end of the blade against the ground at point R′. It can thus be seen that the above-described tilt means will function to aid push arms 13 in absorbing compressive forces imposed on the blade during an earthmoving operation.

The tilt means is further constructed and arranged to aid in stabilizing the mounting arrangement connecting the blade to the tractor and compensates for torsional forces normally imposed on the various pivot means connecting the tilt means therebetween. When the blade is raised above ground level, reaction points L′ and R′ will move to pivot means 14 upon tilting of the blade. It should be understood that such tilt means can be employed with other types of work implements.

I claim:

1. In a mounting arrangement interconnected between a unitary work implement and a vehicle, the invention comprising combined support and tilt means, including first and second members each pivotally interconnected between said work implement and said vehicle and extensible and retractable actuating means pivotally interconnected directly between said first and second members for selectively pivoting said members relative to each other to tilt said work implement by alternately raising opposite ends thereof upon alternate extension and retraction of said actuating means.

2. The mounting arrangement of claim 1 further comprising a pair of laterally spaced push arms each pivotally interconnected between said work implement and said vehicle.

3. The mounting arrangement of claim 2 wherein said tilt means and said push arms are at least substantially parallel and extend downwardly from said vehicle towards said work implement to define a parallelogram linkage therewith.

4. The mounting arrangement of claim 2 further comprising double-acting lift cylinder means pivotally interconnected between said work implement and said vehicle for selectively raising or lowering said work implement relative to said vehicle.

5. The mounting arrangement of claim 4 wherein said work implement constitutes a bulldozer blade and said vehicle constitutes a tractor.

6. The mounting arrangement of claim 1 wherein said first and second members are at least substantially co-planar and extend downwardly and forwardly towards said work implement from said vehicle.

7. The mounting arrangement of claim 6 wherein each of said first and second members is at least generally in the shape of a scalene triangle.

8. The mounting arrangement of claim 7 wherein laterally disposed outboard sides of said first and second members, each defining a base of a respective said triangle, and pivotally interconnected between said work implement and said vehicle.

9. The mounting arrangement of claim 8 wherein adjacent inboard sides of said first and second members, each defining an apex of a respective said triangle, are spaced apart in the direction of the longitudinal axis of said vehicle and pivotally connected together by said actuating means.

10. The mounting arrangement of claim 9 wherein said actuating means constitutes a double-acting hydraulic cylinder at least substantially disposed in an imaginary vertically disposed plane intersecting said axis.

11. The mounting arrangement of claim 10 wherein said cylinder extends downwardly and forwardly from said vehicle towards said work implement.

12. The mounting arrangement of claim 1 wherein each of said first and second members are pivotally interconnected between said work implement and said vehicle by a pair of universal ball and socket connections and wherein said actuating means is pivotally interconnected between said first and second members by a pair of universal ball and socket connections.

* * * * *